United States Patent [19]

Morgan

[11] 4,422,399

[45] Dec. 27, 1983

[54] MEANS FOR INCREASING THE EFFICIENCY OF AN ICE DISAGGREGATION SYSTEM

[75] Inventor: George W. Morgan, La Jolla, Calif.

[73] Assignee: Suncor, Inc., Toronto, Canada

[21] Appl. No.: 940,245

[22] Filed: Sep. 7, 1978

[51] Int. Cl.[3] ..... B63B 35/08

[52] U.S. Cl. ..... 114/42; 37/244

[58] Field of Search ..... 37/43 R, 43 K; 173/522, 173/545, 122, 532, 540, 544; 114/40–42; 299/24, 25, 91–93; 405/217, 61

[56] References Cited

U.S. PATENT DOCUMENTS

| | | | |
|---|---|---|---|
| 936,793 | 10/1909 | Middleton | 299/93 |
| 1,258,109 | 3/1918 | Goeldner | 172/532 |
| 2,346,317 | 4/1944 | Lyle | 172/540 |
| 2,665,655 | 1/1954 | Brown | 114/42 |
| 2,856,708 | 10/1958 | Schnore | 299/91 |
| 3,303,588 | 7/1967 | Krause | 37/43 R |
| 3,768,428 | 10/1973 | Schirtzinger | 114/42 |
| 4,005,666 | 2/1977 | Schirtzinger | 114/42 |
| 4,070,062 | 1/1978 | Morgan | 114/42 |

*Primary Examiner*—S. D. Basinger
*Assistant Examiner*—Jesus D. Sotelo
*Attorney, Agent, or Firm*—J. Edward Hess; Donald R. Johnson; James H. Phillips

[57] ABSTRACT

In an ice disaggregation system employing teeth affixed to a bracket which is spirally disposed around the outer periphery of a cylindrical rotating drum and held in spaced relationship therefrom, the cutting capacity is improved by tilting the plane of each tooth with respect to the drum's axis of rotation such that each incremental section of ice which a tooth engages is subjected to a bending force about a pivot near an area from which ice has been removed and is therefore relatively weak. As a result, the ice readily fractures in relatively large chunks.

3 Claims, 12 Drawing Figures

MEANS FOR INCREASING THE EFFICIENCY OF AN ICE DISAGGREGATION SYSTEM

CROSS-REFERENCE TO RELATED APPLICATIONS

This application contains subject matter related to U.S. patent application Ser. No. 940,247 filed on even date herewith and entitled "Ice Disaggregation System", now U.S. Pat. No. 4,365,571; and to U.S. patent application Ser. No. 940,246, filed on even date herewith and entitled "Multiple-Tine Ice Disaggregation Teeth", now U.S. Pat. No. 4,348,059 . George W. Morgan is the inventor in both of the foregoing references, and each is assigned to the common assignee herewith.

BACKGROUND OF THE INVENTION

This invention relates to the ice disaggregating arts and, more particularly, to aspects of the ice engaging teeth and of the means by which supported upon a large, vertically oriented drum adapted to engage and disaggregate ice.

In the petroleum exploration and production industry, it is often necessary to move and station men and equipment in relatively hostile environmental regions. In recent years, the emphasis on oil production from the far north has necessitated the development of new techniques for encountering formations of encroaching ice floes and the movements thereof which threaten the stability and/or position of equipment situated therearound.

In the Arctic, large offshore regions are often covered by thick layers of ice. Currently, there is considerable activity in this and other frozen areas directed toward the discovery and development of sources of petroleum and other natural resources. The search for and production of these resources require operational platforms for housing equipment and personnel. These platforms are manually transported to their operational sites and are maintained in a relatively fixed position with respect to the underwater floor by anchoring thereto and/or the utilization of dynamic positioning techniques. It may be noted, however, that some such platforms are self-propelled. In the normal course of operation, pipes are extended from the platform into the earth's sub-surface for the recovery of natural resources such as petroleum. It is thus important to maintain the platform within a predetermined envelope in order to prevent breaking or withdrawing the pipe from the earth.

Platforms located in both shallow and deep covered waters are exposed to ice floes which sometimes float freely on the water and/or a unitary ice mass which flow insidiously. The ice may be comprised of such mass that a platform is susceptible to damage or destruction as a result of forces imparted thereagainst by the moving ice. The Arctic Ocean, for example, is characterized by air temperatures ranging from −70° F. to 70° F., ice sheets and thicknesses between 6 and 10 feet, and pressure ridges of 10 feet, and pressure ridges of 10 to 100 feet. In such conditions, ice typically exhibits a compressive strength of 1,000–3,000 psi and tensile strength of 300–1,000 psi. The problems of providing the requisite magnitude of force and power necessary for engagement with and disaggregation of such an environmental threat may be seen to be formidable.

Drilling and operations platforms for use in ice covered areas may take several different forms. One such platform includes a monopod, semi-submersible design utilizing a single rotating cutter completely encircling the intermediate hull section proximate the waterline for ice floe engagement and disaggregation. The cutter is disposed between upper superstructure comprising an operations platform and a submerged hull providing flotation. In this manner, only a relatively narrow profile emerges through encroaching ice layers while platform surface area is maximized and buoyancy size parameters are met, respectively, above and below the ice.

A similar operations platform, which is disclosed in detail in U.S. patent application Ser. No. 772,784, filed Feb. 28, 1977, and entitled "Operations Vessel for Ice Covered Seas", now U.S. Pat. No. 4,102,288, includes a monopod, semi-submersible drilling vessel constructed with an ice breaking bow and aft ice disaggregation apparatus comprising an intermediate hull section. The bow is constructed in the form of a nautical wedge for facilitating transit operation in both open and ice laden waters and for breaking ice within its capability while in the operating mode. In addition, the intermediate hull section also includes a plurality of drums rotatably mounted in generally upstanding relationship relative to the submersible hull. The drums are comprised of an outer surface adapted for breaking, cutting and/or chipping ice engaged thereby. Typically, a pair of drums is mounted for counterrotation such that reaction torque is cancelled.

A floating platform which employs somewhat similar ice engaging and disaggregating means is disclosed in U.S. Pat. No. 4,070,052 entitled "Method and Apparatus for Disaggregating Particulate Matter". The platform disclosed therein includes ice disaggregating apparatus supported by booms which include telescoping struts which support the ice disaggregation apparatus for movement around the entire platform. More particularly, an array of rotatable cutting drums is configured with the axis of rotation of one drum forming an oblique angle with the axis of rotation of a second drum. Rotation of the drums produces improved mass removal effectiveness by first cutting and chipping serrations to form ridges therebetween which subsequently shatter when struck at an oblique angle by the cutters of a second drum. In a variant configuration, an array of three, independently rotatable drums mounted in a triangular configuration is employed. Each drum is comprised of a generally elliptical cross-sectional shape wherein teeth protruding outwardly of adjacent drums do not overlap.

Yet another ice disaggregating system of interest as prior art to the present invention is disclosed in U.S. Pat. No. 4,069,783 entitled "Method and Apparatus for Disaggregating Particulate Matter". As disclosed and discussed in detail therein, the ice disaggregation system comprises the employment of a vertically oriented, rotatable drum disposed ahead of, and adapted to sweep across the path of, a ship from which the drum is supported. The teeth disposed on the rotatable drum have aligned pairs of sledging teeth or progressively increasing lengths extending therefrom. Adjacent each array of aligned pairs of sledging teeth, centrally positioned therebetween and to the rotative rear thereof, there is provided a slugging tooth adapted for striking engagement with the particulate matter engaged and laterally isolated therebetween by the sledging teeth.

It is important to appreciate that the teeth carrying, ice engaging drums discussed in the foregoing are all very large, particularly those associated with the semi-submersible operations vessels. It has been found that, when such drums become so large, the configuration of the ice engaging teeth and their respective mounting means is of great importance if acceptable efficiency is to be obtained in driving the ice disengaging drums and if acceptable tooth life and maintenance methods are to be obtained. That is, the relatively straightforward tooth designs and mounting means characteristic of conventional drum ice disaggregating means (which have been in use for many years) cannot simply be scaled up to obtain the desired quality and economy of operation, fabrication, and maintenance necessary in such very large installations as herein contemplated.

SUMMARY OF THE INVENTION

It is therefore a broad object of this invention to provide improved ice disaggregation means.

It is therefore another object of this invention to provide improved ice engaging teeth especially suited for employment around the outer periphery of a large cylindrical rotating drum for engagement with large ice masses.

In a more particular aspect, it is an object of this invention to provide such ice engaging teeth which are oriented to address the ice such that ice chunks are placed in a relatively weak tension strain mode and are thereby more easily fractured.

Briefly, these and other objects of the invention are accomplished by tilting the plane of each tooth with respect to the drum's axis rotation such that each incremental section of ice which a tooth engages is subjected to a bending force about a pivot near an area from which the ice has been removed and is therefore relatively weak. As a result, the ice readily fractures in large chunks.

DESCRIPTION OF THE DRAWING

The subject matter of the invention is particularly pointed out and distinctly claimed in the concluding portion of the specification. The invention, however, both as to organization and method of operation may best be understood by reference to the following description taken in conjunction with the accompanying drawing of which:

DESCRIPTION OF THE PREFERRED EMBODIMENT

Figure 1:
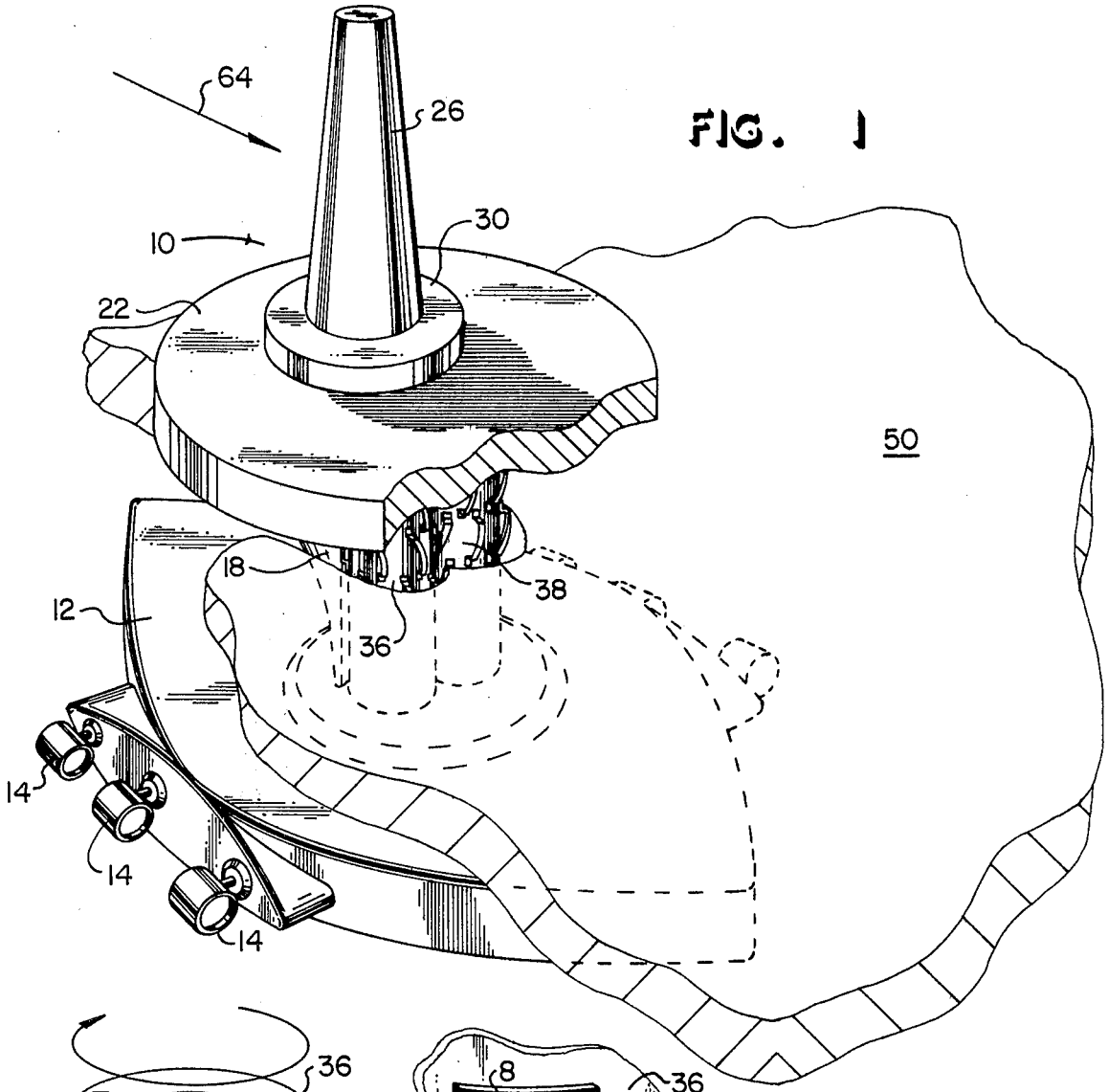
FIG. 1 illustrates a typical environment in which the present invention finds favorable use, which environment comprises a semi-submersible operations platform fitted with very large ice disaggregating means.

Referring now to FIG. 1, an exemplary environment for the present invention is shown and comprises an operations vessel 10 which is a semi-submersible, monopod type platform for drilling, production, processing, and/or storage and the like. The platform 10 is provided with a flotation hull section 12 adapted for submerged support and sustenance of the remaining vessel and also providing storage therefor. A plurality of propulsion units 14 are constructed around the flotation hull 12 for providing a transit mode of operation, dynamic positioning while in a stationary mode, and the capacity to engage ice floes in the positioning and operation thereof.

The platform 10 is constructed with an intermediate hull section extending upwardly from the flotation hull 12 and includes a nautical wedge portion 18 and an ice disaggregation portion comprising counter-rotating drums 36 and 38. Atop the intermediate hull, a deck structure 22 is constructed for housing above-water operations. A shrouded derrick 26 upstands from the deck structure 22, the shroud being provided for safety and environmental protection and for decreasing wind drag forces. An operations area 30 is similarly provided in a shrouded configuration beneath and adjacent the derrick 26 for protecting platform personnel during platform operations. In the shrouded configuration shown, the topside profile of the platform 10 is substantially comprised of circular shapes which eliminate wind direction sensitivity to the vessel.

In FIG. 1, the platform 10 is shown advancing in a transit mode through an ice sheet 50. It will be observed that counter-rotating drum cutters 36, 38, disaggregate the ice sheet in order to permit relative movement (indicated by the arrow 64) between the ice sheet 50 and the platform 10 in a direction generally governed by the orientation of the thrusters 14. More detailed description of the operations vessel 10 will be found in the aforementioned U.S. patent application Ser. No. 772,787, now U.S. Pat. No. 4,102,288. As previously indicated, the present invention is directed to improvements in the teeth structure associated with the ice disaggregating drums 36, 38 or similar ice disaggregating drums.

Figure 2:
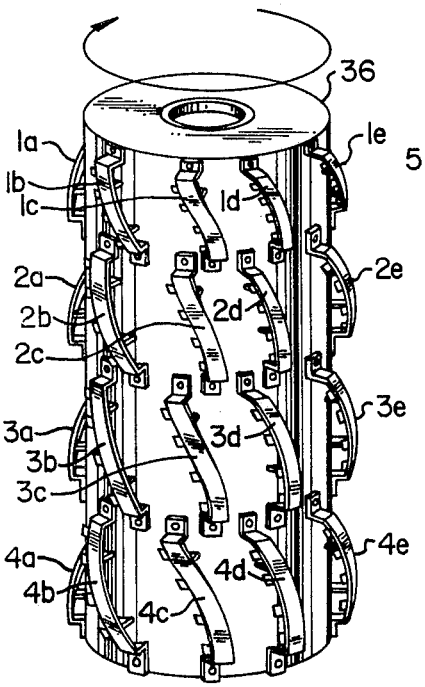
FIG. 2 is a view of one of the ice disaggregating drums employed in the operations platform in FIG. 1.

It is important, in order to obtain a full understanding of the present invention, that some appreciation of the size of the relevant structure be obtained. Thus, referring to FIG. 2 which is an isolated view of the disaggregating drum 36, it will be understood that the axial dimension of the drum 36 is on the order of 50 to 100 feet or even more. As shown in FIG. 2, the drum 36 is provided with a plurality of axially displaced, circumferentially distributed rows of tooth-carrying brackets 1*a*, 1*b*, 1*c*, 1*d*, 1*e*; 2*a*, 2*b*, 2*c*, 2*d*, 2*e*; 3*a*, 3*b*, 3*c*, 3*d*, 3*e*; and 4*a*, 4*c*, 4*d*, 4*e*. It will be understood, of course, that the bracket rows extend around the complete circumference of the drum 36. The brackets in adjacent axially displaced rows are generally arranged in a spiral. Thus, bracket 1*b* leads bracket 2*c* which leads bracket 3*d* which leads bracket 4*e*, etc.

Figure 3:
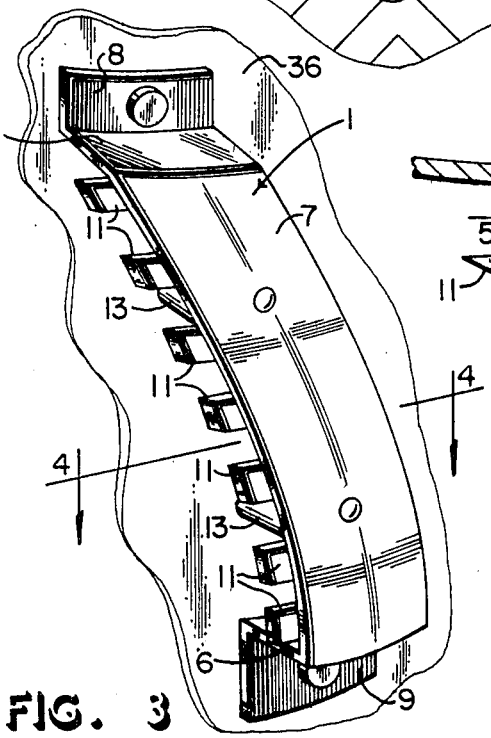
FIG. 3 is a detailed view of one configuration for a bracket/tooth unit as employed on the drum illustrated in FIG. 2.

As best shown in FIG. 3, each bracket, such as the bracket 1, comprises upper and lower standoff portions 5, 6, between the outer ends of which extends a tooth-carrying beam portion 7. Upper and lower foot portions 8, 9, of the bracket 1 bear against the surface of the drum 36 to provide areas of attachment thereto for the bracket 1.

Figure 4:
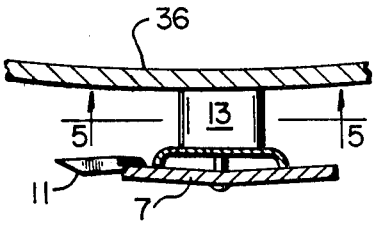
FIG. 4 is a view taken along the lines 4—4 of FIG. 3.
Figure 5:
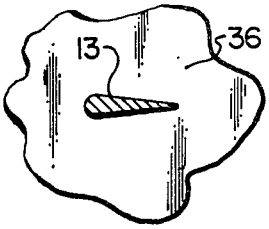
FIG. 5 is a cross-sectional view taken along the lines 5—5 of FIG. 4.

With respect to dimensions, the lengths of the stand-off portions 5 and 6 of the bracket 1 are such that the beam portion 7 stands away from the surface of the drum 36 several feet; i.e., on the order of 2–5 feet. The beam portion 7 of the bracket 1 carries a plurality of forward-facing, ice-engaging teeth 11. Intermediate the length of the beam portion 7 may be provided one or more support members 13 which extend from the surface of the drum 36 to the underside of the beam portion 7, thereby imparting additional rigidity thereto. FIGS. 4 and 5 illustrate one specific configuration for the support member 13 and its orientation with respect to the beam portion 7 of the bracket 1.

In operation, as the teeth 11 engage and fracture the ice in chunks, the ice chunks float toward the surface and are discharged to the rear. During their upward transit, the chunks may pass between the surface of the drum and the beam portion 7 of the brackets, sufficient clearance being provided, as previously stated, to obtain that facility.

Figure 6:
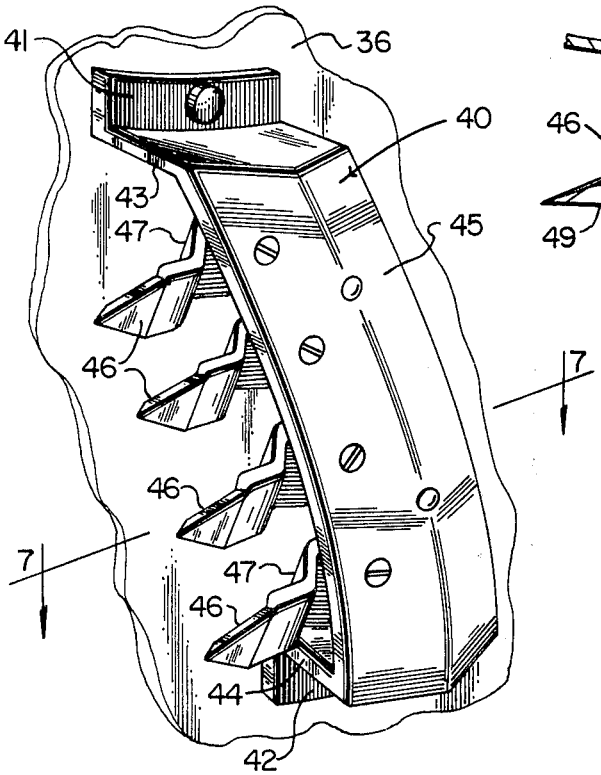
FIG. 6 illustrates a variant configuration for a bracket/tooth unit which may be employed on the drum of FIG. 2.
Figure 7:
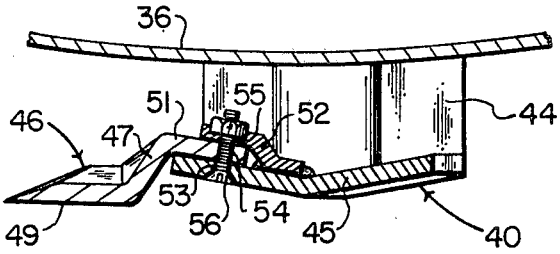
FIG. 7 is a cross-sectional view taken along the lines 7—7 of FIG. 6.
Figure 8:
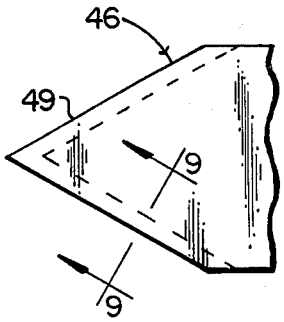
FIG. 8 is a partial view of one of the teeth illustrated in FIGS. 6 and 7 showing certain details of its preferred construction.
Figure 10:
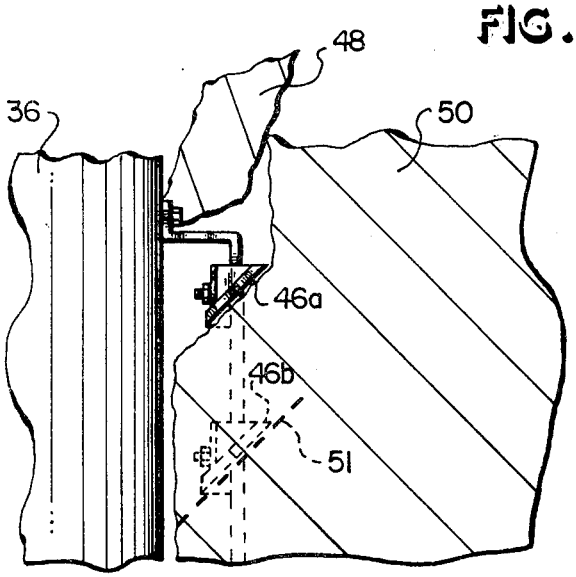
FIG. 10 is a fragmentary view illustrating the operation of the bracket/tooth combination illustrated in FIG. 6 as it is effecting ice disaggregation.

The teeth 11 depicted in FIGS. 2–5 are oriented generally parallel to the axis of the cylinder 36, and efficient ice disaggregation is accomplished with such teeth. However, attention is directed to a more efficient tooth orientation illustrated in FIG. 6. A bracket 40, comprising foot portions 41 and 42, standoff portions 43 and 44, and a beam portion 45, supports a plurality of ice-disaggregating teeth 46. As best shown in FIG. 7, each tooth 46 includes an intermediate section 47 which is twisted to bring the ice-engaging forward section of the tooth into an angular relationship with respect to the axis of the drum 36. The twist is imparted in a direction such that the upper edge of the ice-engaging forward section of each tooth 36 is radially outwardly disposed with respect to the lower edge. The effect of this orientation may best be appreciated with reference to FIG. 10 which illustrates an ice chunk 48 which has just been separated from the ice sheet 50 by the action of the tooth 46*a*. The following tooth 46*b* is fracturing the ice in the region 51, and the stress is in the tension mode, thus tending to lift and pry the ice chunk intermediate the teeth 46*a* and 46*b* upwardly and away from the ice sheet 50. It will be appreciated that a much more efficient fracture mode is thereby obtained which significantly lowers the power required to disaggregate the ice.

Figure 9:
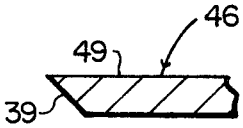
FIG. 9 is a cross-sectional view taken along the lines 9—9 of FIG. 8.

The point configuration of the teeth 46 is preferable to the broad chisel edge of the teeth 11 shown in FIG. 3. In addition, by raking the ice engaging edge of the teeth 46, as shown in the region 39 of FIG. 9, the cutting abilities and the life of a tooth before reconditioning is necessary is substantially improved.

Because of the need to replace broken teeth, as well as to periodically recondition worn teeth, the individual teeth are preferably individually replaceable. Referring again to FIG. 7, a tooth 46 having a twisted portion 47, a tine portion 49 and a base portion 51 is shown affixed to the beam portion 45 of the bracket 40. A brace 52 is fixed to the inside surface of the beam portion 45 and has a forward portion which extends toward the surface of the drum 36 and, in conjunction with a forward region of the beam portion 45, defines a recess for receiving the base portion 51 of the tooth 46. An aperture 54 through the base portion 51 of the tooth 46 is brought into alignment with corresponding apertures 53 and 55 in the beam portion 45 and the brace 52, respectively, in order that nut and bolt means 56 may be employed to secure the tooth 46 to the bracket 40. The brace 52 is preferably permanently welded to the inside of the beam portion 45 whereas any convenient means alternative to the nut and bolt 56 may be utilized to removably fix the tooth 46 in place. The dimensions in FIG. 7 are somewhat distorted to permit a clear illustration of the subject matter explained therein. In particular, as previously noted, the height of the stand-off portion 44 of the bracket 40 is several feet and is thus shown substantially undersized in FIG. 7.

Figure 11:
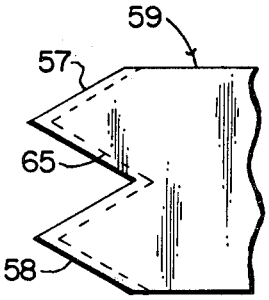
FIG. 11 is a partial view of a variant, multiple tined tooth which may be employed in either of the bracket/tooth units illustrated in FIGS. 3 and 6.
Figure 12:
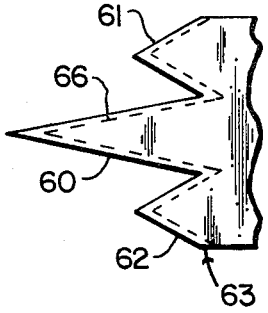
FIG. 12 is a partial view illustrating another variant multiple tined tooth which may be employed in the bracket/tooth units illustrated in FIGS. 3 and 6.

In addition to the single timed tooth configuration illustrated in FIGS. 6–9 and the chisel configuration shown in FIGS. 3 and 4, it has been found that multiple tine tooth configurations as illustrated in FIGS. 11 and 12 afford further increases in the efficiency of ice disaggregation by the system. As shown in FIG. 11, a plurality (two, as shown) of identical spaced apart tines 57, 58 are employed on the alternate embodiment tooth 59 illustrated. FIG. 12 presents a still more efficient tooth configuration which utilizes a central, relatively long tine 60 flanked by shorter tines 61 and 62 for the tooth 63. As indicated by the dashed lines 65 and 66, respectively, one face of each of the teeth 59 and 63 has an undercut leading edge corresponding to the region 39 of the tooth 46 illustrated in FIG. 9. The same benefits accrue therefrom to the alternate configured teeth 59 and 63.

While the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

What is claimed is:

1. In an ice disaggregation system characterized by at least one rotating drum, which drum carries ice engaging teeth structure on the peripheral surface thereof, the improvement comprising:

(A) a plurality of tooth supporting brackets distributed about and affixed to the peripheral surface of the drum, each of said brackets including an elongated tooth carrying beam portion disposed generally parallel to the drum peripheral surface and rigidly supported outwardly therefrom by a plurality of bracket legs;

(B) a plurality of ice engaging teeth fixed to said bracket beam portion, each of said teeth having a sharp, ice engaging forward portion, said teeth being oriented such that the forward portions thereof generally face the direction of drum rotation; and (C) each of said teeth being further oriented such that said forward portion is disposed at an acute angle with respect to the drum axis, the upper edge of said forward portion extending radially outwardly further from the drum surface than the lower edge thereof.

2. The system of claim 1 in which each of said teeth is individually removably affixed to its corresponding bracket.

3. The system of claim 2 which further includes a brace member having a rearward portion affixed to the surface of said bracket which faces the surface of said drum, said brace member having a forward portion spaced from said bracket and defining a recess therewith, each of said teeth further having a rearward portion, said recess being adapted to receive and brace said tooth rearward portion, and means for removably securing each said tooth rearward portion in said recess.

* * * * *